US008733981B2

(12) United States Patent
Jiang et al.

(10) Patent No.: US 8,733,981 B2
(45) Date of Patent: May 27, 2014

(54) LENS WITH MULTIPLE CURVED SURFACES FOR LED PROJECTING LAMP

(75) Inventors: Jin Bo Jiang, Hong Kong (HK); Wen Da Jiang, Hong Kong (HK)

(73) Assignee: Huizhou Light Engine Limited, Huizhou, Guangdong (CN)

( * ) Notice: Subject to any disclaimer, the term of this patent is extended or adjusted under 35 U.S.C. 154(b) by 52 days.

(21) Appl. No.: 13/480,561

(22) Filed: May 25, 2012

(65) Prior Publication Data

US 2013/0314925 A1 Nov. 28, 2013

(51) Int. Cl.
*F21V 3/00* (2006.01)

(52) U.S. Cl.
USPC ..... 362/311.02; 362/311.01

(58) Field of Classification Search
USPC ..... 362/311.01–311.02, 311.09, 335
See application file for complete search history.

(56) References Cited

U.S. PATENT DOCUMENTS

| | | | | |
|---|---|---|---|---|
| 7,251,084 | B2 | 7/2007 | Shimura | |
| 8,220,975 | B2 | 7/2012 | Miyashita et al. | |
| 8,246,216 | B2 * | 8/2012 | Jiang et al. | 362/308 |
| 2010/0284194 | A1 * | 11/2010 | Miyashita et al. | 362/311.09 |
| 2010/0309660 | A1 | 12/2010 | Lim et al. | |
| 2011/0286221 | A1 | 11/2011 | Saito | |

FOREIGN PATENT DOCUMENTS

| | | | |
|---|---|---|---|
| CN | 1576898 | A | 2/2005 |
| CN | 201436456 | U | 4/2010 |
| CN | 101907263 | A | 12/2010 |
| CN | 201852037 | U | 6/2011 |
| CN | 102278703 | A | 12/2011 |
| CN | 102287647 | A | 12/2011 |
| CN | 102313244 | A | 1/2012 |
| JP | 2004-191718 | A | 7/2004 |

* cited by examiner

*Primary Examiner* — Anne Hines
(74) *Attorney, Agent, or Firm* — Muncy, Geissler, Olds & Lowe, P.C.

(57) ABSTRACT

This invention relates to a secondary optics for the multi-chip LED. It features in that the optics consists of a refraction collimating portion, two total internal reflection (TIR) portions, an emitting surface with a micro lens array, an edge flange and a snap lug for lens assembly. The refraction collimating portion is located on the center of the lens bottom, which has a convex aspheric surface. Around the refraction collimating portion outwards, there are two rounds of TIR prisms, featured in that at least one TIR prism has a flake polyhedral reflection surface. On top of the secondary optics, there is the emitting surface constituted with the micro lens array. The edge flange and the snap lug for lens positioning represent non operational portion and may have any shape. Related to the present invention, the LED used therewith may be a multi-chip or single-chip LED.

12 Claims, 7 Drawing Sheets

LENS WITH MULTIPLE CURVED SURFACES FOR LED PROJECTING LAMP

FIELD OF THE INVENTION

The present invention relates to an optical apparatus for LED (Light Emission Diode Solid State Lighting) projecting lamp, in particular, to a secondary optical lens for light mixing for a multi-chip LED.

BACKGROUND OF THE INVENTION

A Par (Parabolic Aluminum Reflector) lamp for indoor illumination is a projecting lamp. A Metal Halogen Lamp is an LED Par lamp has tens or more than one hundred watts to generally function as the light source for the conventional Par lamp and only requires an array-chip LED of several or more than ten watts. A regular shadow occurs if a lens with smooth surfaces is used in multi-chip LEDs because the arrangement of the chips one by one produces an imaging effect in the light spot projected. With regard to LEDs having chips with different colors including red, green and blue, uneven light spots with colors may present at different locations in the projection area. In this case, a light mixing process is generally required. Referring to FIG. 2, the basic structure of most of the current lens comprises a smooth aspheric lens in the centre, around which a circular arrangement of total reflection prisms are located. Such lens has a very large height as the lamp has a relatively large caliber which requires the use of a much thicker plastic material when injection molding. This causes relatively strong shrinkage, and also a relatively long cycle time needed for injection molding of a single lens. Consequently, this influences the light distribution performance, production efficiency and cost of the lens.

There is a desire to produce a secondary optical lens with a height that is reduced to half of that of the prior art lens. There is also a desire that this secondary optical lens has reflective surfaces to reflect light and enable light mixing such that the projected light spots change gently and the light spot has the same color temperature in the centre and at the edge. This eliminates the shadow caused by the arrangement of LED chips presented in the projected light spot due to imaging effect.

SUMMARY OF THE INVENTION

According to one aspect of the invention, there is provided a lens comprising:

a light-exiting surface provided on a top side of the lens;

a central light-refracting and collimating portion comprising a convex aspheric surface formed on a bottom side of the lens at a centre thereof for refracting and collimating a first portion of light emitting from an LED (light emitting diode) towards the light-exiting surface;

a first annular prism portion formed around the central light-refracting and collimating portion, and having a first refractive surface and a first total reflective surface, whereby a second portion of the light emitting from the LED is refracted by the first refractive surface and then reflected by the first total reflective surface into parallel beams towards the light-emitting surface; and a second annular prism portion formed around the first annular prism portion, and having a second refractive surface and a second total reflective surface, whereby a third portion of the light emitting from the LED is refracted by the second refractive surface and then reflected by the second total reflective surface into parallel beams towards the light-emitting surface.

In one embodiment, the convex aspheric surface is configured to receive the first portion of the light emitting at an angle of about 0° to about 32° from an optical axis of the lens, the first refractive surface is configured to receive the second portion of the light emitting at an angle of about 32° to about 56° from the optical axis of the lens, and the second refractive surface is configured to receive the third portion of the light emitting at an angle of about 56° to about 90° from the optical axis of the lens.

In one embodiment, the light-exiting surface comprises an array of micro lens.

In one embodiment, the light distribution angle of the micro lens is about 8° to about 46°.

In one embodiment, the array of micro lens is any one from the group consisting: radiant, hexagonal honeycomb and square grid.

In one embodiment, at least one of the first and second total reflective surfaces is in the form of a scale-like polyhedron.

In one embodiment, both the first and the second total reflective surfaces are in the form of scale-like polyhedrons having the same shape.

In one embodiment, both the first and the second total reflective surfaces are in the form of scale-like polyhedrons having different shapes.

In one embodiment, the first total reflective surface is a smooth surface.

In one embodiment, the first total reflective surface is in the form of a scale-like polyhedron comprising surfaces selected from the group consisting of square, hexagonal and diamond-shaped surfaces.

In one embodiment, the second total reflective surface is in the form of a scale-like polyhedron comprising surfaces selected from the group consisting of square, hexagonal and diamond-shaped surfaces.

In one embodiment, the LED is a single-chip or multi-chip LED, with one or more colors of red, green or blue.

The lens further includes an annular flange formed around the second annular prism portion, and a plurality of lugs extending from the annular flange to facilitate the positioning of the lens.

BRIEF DESCRIPTION OF THE DRAWINGS

The accompanying drawings, which are incorporated in and constitute a part of this specification, illustrate an implementation of the invention and, together with the description, serve to explain the advantages and principles of the invention. In the drawings.

DETAILED DESCRIPTION OF EMBODIMENTS OF THE INVENTION

Embodiment 1

Figure 1:
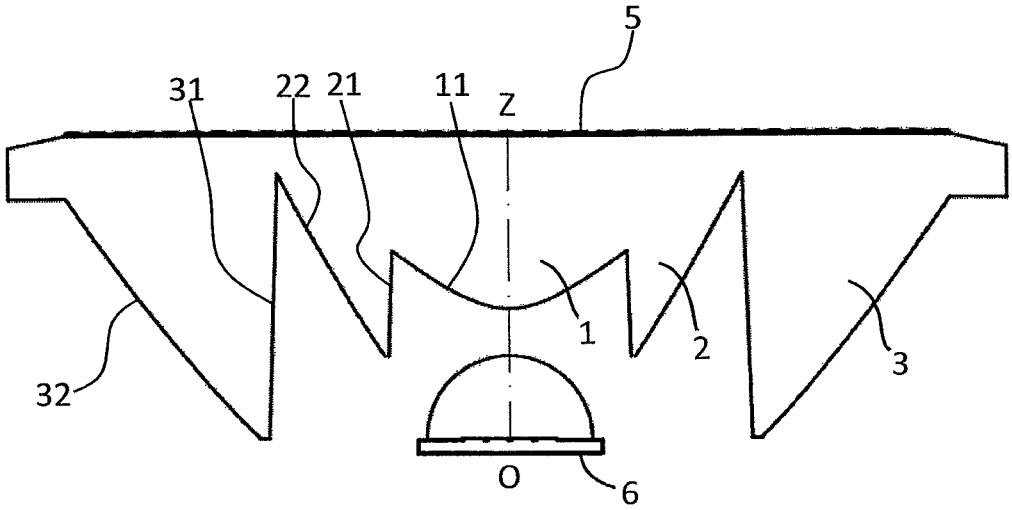
FIG. 1 is a cross section of the secondary optical lens according to a first embodiment of the present invention.
Figure 2:
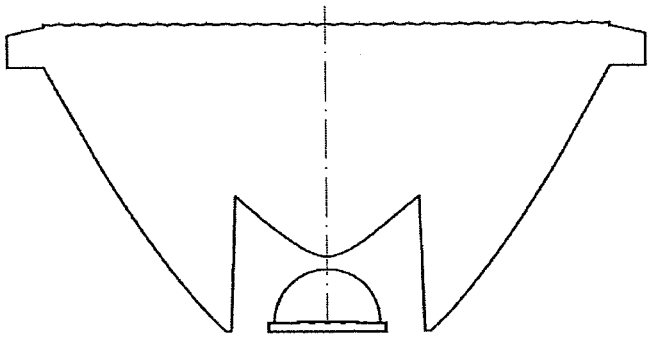
FIG. 2 PRIOR ART
FIG. 2 shows the basic structure of an LED lens of the prior art.

The present invention relates to a secondary optical lens. Embodiment 1 of the present invention is shown in cross section in FIG. 1. The lens consists of an aspheric refraction collimating portion 1 on the bottom thereof in the centre, two total reflection portions 2 and 3, an emitting surface 5 constituted with a micro lens array, and a lens edge 4, characterized in that it has an aspheric collimating surface 11. Around the outer portion of the aspheric collimating surface 11, there are two rounds of total reflection prisms 2 and 3, characterized in that a reflection surface 22 of the inner total reflection prism 2 comprises a smooth surface, and that a reflection surface 32 of the outer total reflection prism 3 comprises a square flake polyhedral reflection surface. The emitting surface on top of the secondary optical lens has a micro lens array 5, which may have different curvature radius and arrangement manner in accordance with the light distribution angle and the light spot shape. Embodiment 1 preferably adopts a radiating arrangement in the radial direction. The edge flange 4 of the secondary optical lens is provided with a snap lug 41 for positioning the lens, which represents a non operational portion and may have any shape. In the secondary optical lens according to the present invention, the LED may be a multi-chip LED or single-chip LED. The LED may be a white LED or a color LED in red, green or blue.

Figure 3:
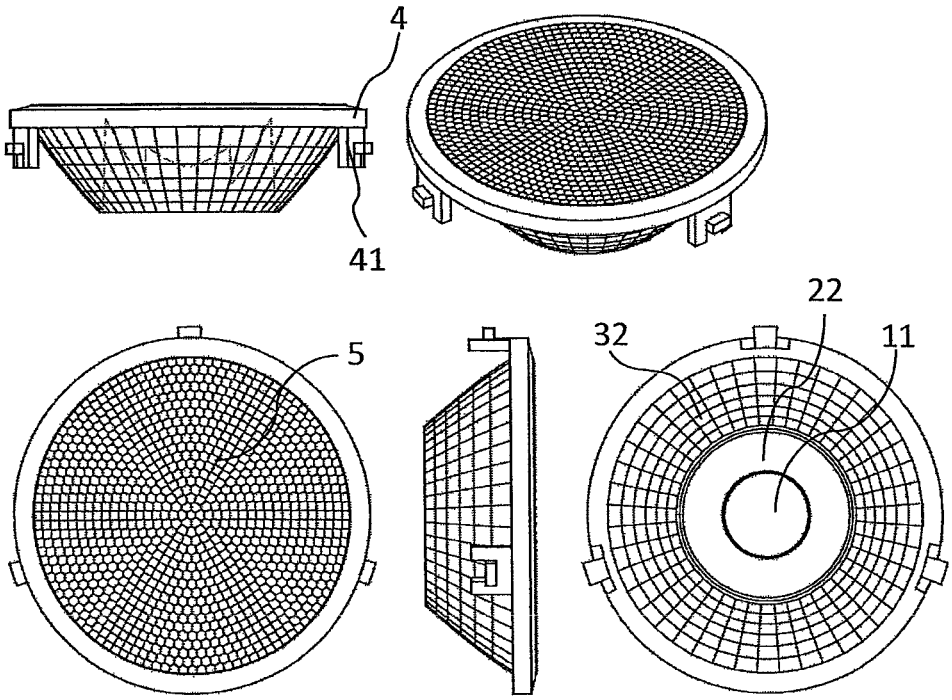
FIG. 3 shows different views of the secondary optical lens of FIG. 1.

FIG. 3 shows the orthographic views of the Embodiment 1 showing sequentially the front view, the isometric view, the plan view, the side view and the bottom view from the upper left area to the lower right area. The micro lens array 5 in the light emitting surface of the lens according to the Embodiment 1 is arranged radially in the radial direction. The reflection surface 22 of the inner total reflection prism 2 is a smooth surface. The reflection surface 32 of the outer total reflection prism 3 is a square flake polyhedral composite curved reflection surface.

Figure 4:
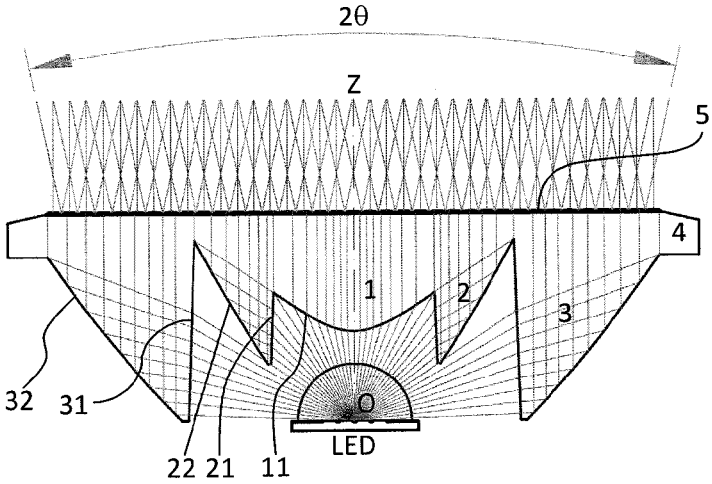
FIG. 4 shows the design principle of the secondary optical lens of FIG. 1.

FIG. 4 shows the design principle of the Embodiment 1. The light is emitted from the central point O of the light emitting surface of the LED chips. Also, light is emitted including an angle from 0 to 32 degrees with the optical axis OZ projects to the refraction portion on the bottom of the lens in the centre. Then light projects collimatingly upward after being refracted by the aspheric surface 11. The light is emitted from the central point O of the light emitting surface of the LED chips. Also, light is emitted including an angle from 32 to 56 degrees with the optical axis OZ projects to the total reflection prism 2, and then is reflected by the total reflection surface 22 after being refracted by the cylindrical surface 21, and projects upward collimatingly after being reflected. The rest of the light including an angle from 56 to 90 degrees with the optical axis OZ projects to the total reflection prism 3 is then reflected by the total reflection surface 32 after being refracted by the cylindrical surface 31. It then projects collimatingly upward after being reflected. The combination of the three parts of the Embodiment 1 collectively yield a very high optical efficiency because all the light emitted from the central point O of the light emitting surface of the LED chips and including an angle from 0 to 90 degree with the optical axis OZ projects upward collimatingly.

According to the Embodiment 1, the light collimated from the refraction portion 1 on the bottom of the lens in the centre, the total reflection portion 2 and 3 in the inner and outer round is subject to light distribution though the micro lens array on top of the lens. The light distribution angle of the micro lens array matches the numerical aperture angle, which means that, if assuming the light distribution angle represents 2θ, then the half angle of the light distribution angle represents the numerical aperture angle θ of each micro lens:

$$NA = n \cdot \sin\theta$$

wherein n represents the refraction ratio of the lens material. The curvature radius of the micro lens may be deducted in accordance with light distribution condition described in the above formula. (AY: need to draft a claim for this. See claim 4 drafted by client)

Here, the light distribution angle 2θ of the micro lens array may comprise any angle within the range from 8 to 46°, preferably 24°.

As each micro lens provides for light distribution within the angle 2θ with respect to a small bundle of light, an even light spot distribution within the angle 2θ may be achieved due to light distribution superimposition from numerous micro lens arrays. The indoor illumination is ideally achieved since the light spot is distributed very gently, as well as the light mixing keeps relatively even and color temperature of the light spot from centre to edge remains consistent due to the flake polyhedral composite curved surface design adopted by the outer reflection surface of the total reflection prism.

The computer simulation and photometric analysis of the Embodiment 1 is described below. Here, it assumes that a multi-chip LED light source from Cree Inc. of U.S. with a model of CREE MT-G is adopted. This LED light source has a luminous flux of 380 lumens, that a screen is placed at a distance of 1 meter in front of the lens for analyzing the spot shape and photometric distribution of the light spot projected forward. Another screen is placed beside the lens for observing the spot shape, illumination distribution and stray light of the light spot projected sideward.

Figure 6:
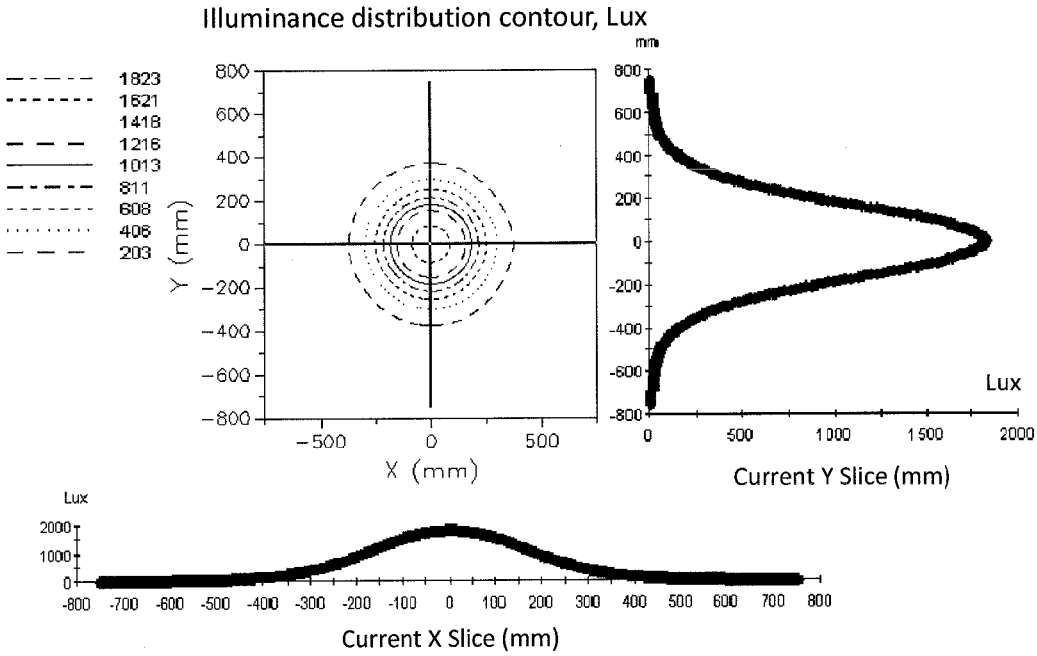
FIG. 6 shows the illumination distribution of the secondary optical lens of FIG. 1 at a distance of 1 meter.
Figure 5:
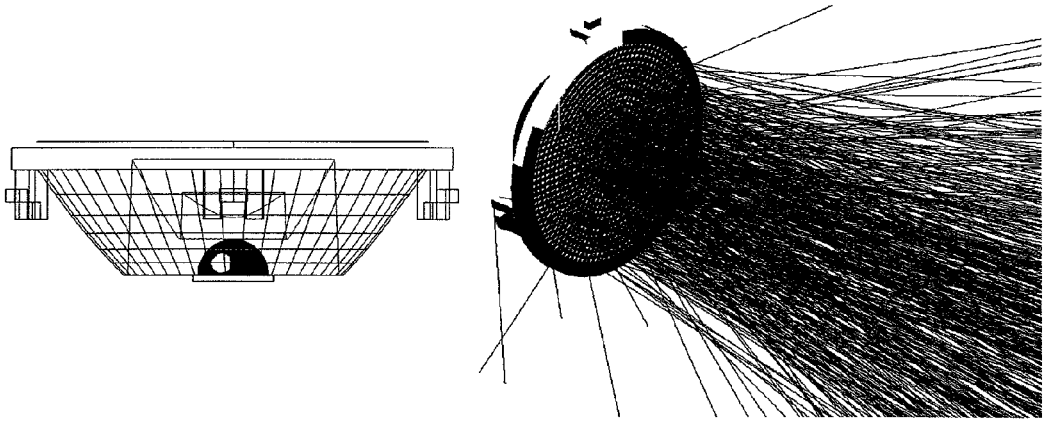
FIG. 5 shows the ray trace of the secondary optical lens of FIG. 1.

FIG. 5 shows the ray trace of the Embodiment 1. FIG. 6 shows the illumination distribution at the distance of 1 meter according to the Embodiment 1. It can be seen that the light spot has a circular shape in light distribution, eliminating the shadow as the arrangement of the LED chips presented in the light spot projected due to imaging effect. The illumination distribution of the light spot has a substantially smooth shape of Gaussian distribution. If it is assumed that the transmittance of the lens material is 92%, then the luminous flux collected in the screen through simulation is 346.57 lumens, while the effective optical efficiency of the Embodiment 1 is computed as:

$$\eta \approx 346.57/380 \cdot 100\% = 91.2\%.$$

Figure 7:
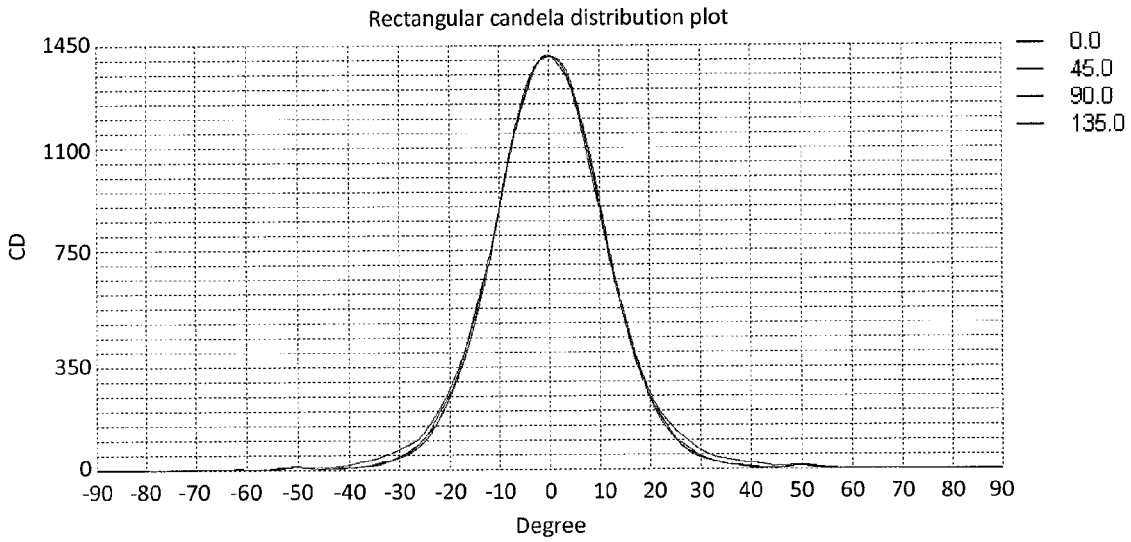
FIG. 7 shows the candela distribution in Cartesian coordinates system.
Figure 8:
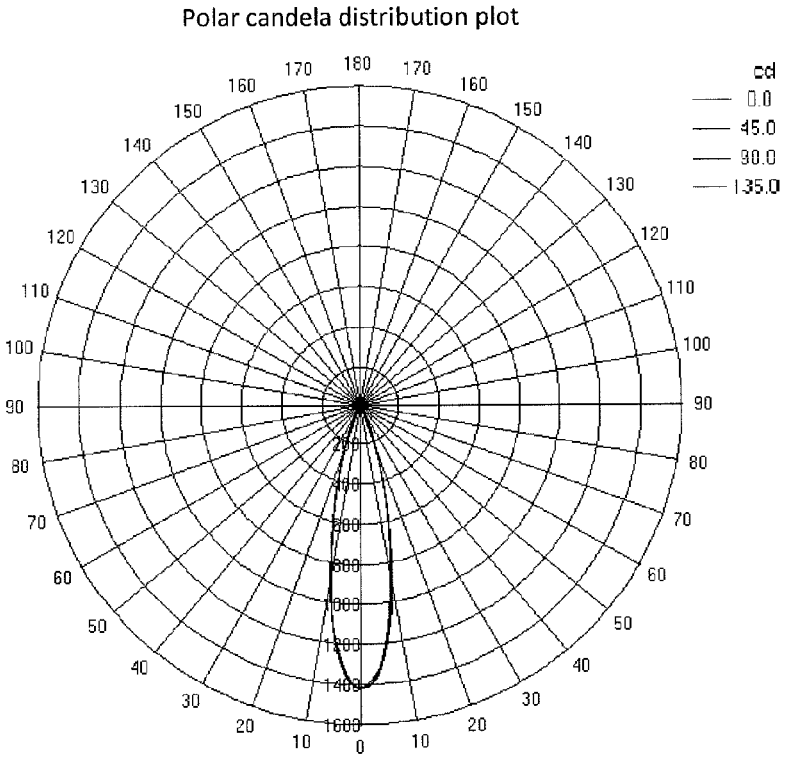
FIG. 8 shows the candela distribution in polar coordinates system.

FIGS. 7 and 8 show the far field angle distribution of the light intensity of the Embodiment 1. FIG. 7 shows the candela distribution in the Cartesian coordinates system. FIG. 8 shows the candela distribution in the polar coordinates system. It is seen that the half angle of the beam angle at the location of half peak light intensity is ±12°, which means that the full angle of the beam angle is 24°.

Figure 9:
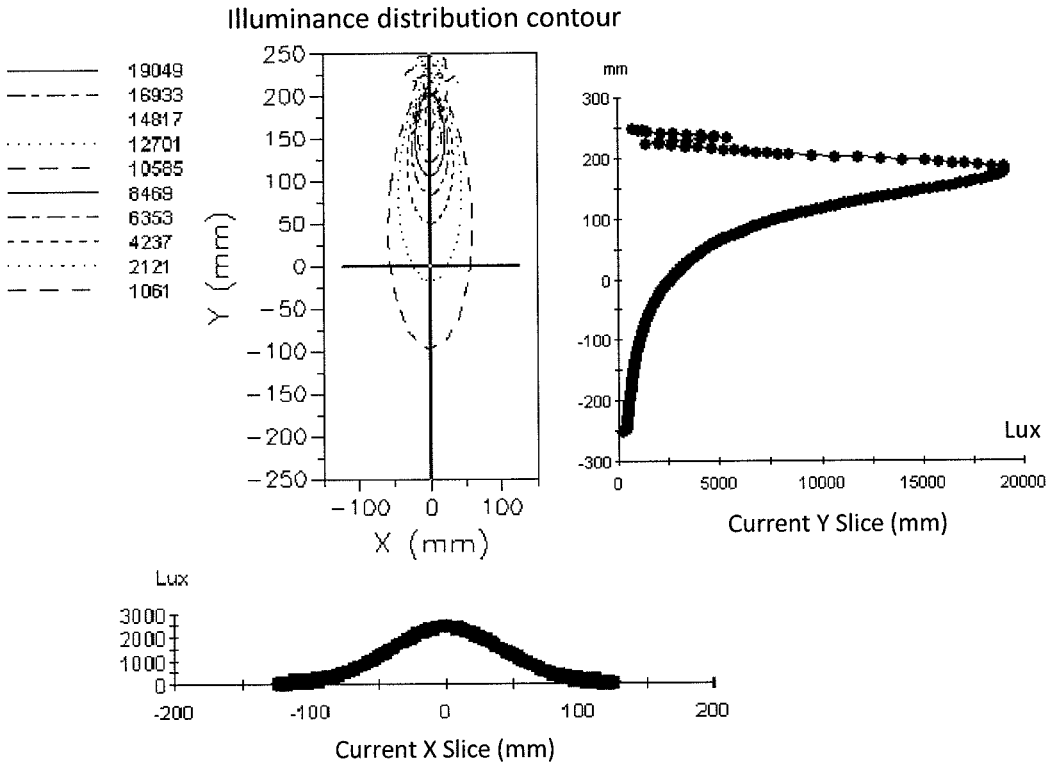
FIG. 9 shows the illumination distribution in the side screen of the secondary optical lens of FIG. 1

FIG. 9 shows the illumination distribution in the side screen according to the Embodiment 1. The top portion of the light spot represents the position of the light emitting port of the lens, where it can be seen that the light spot is in the form of a water drop, almost without spray light at the position of the light emitting port.

Embodiment 2

Figure 10:
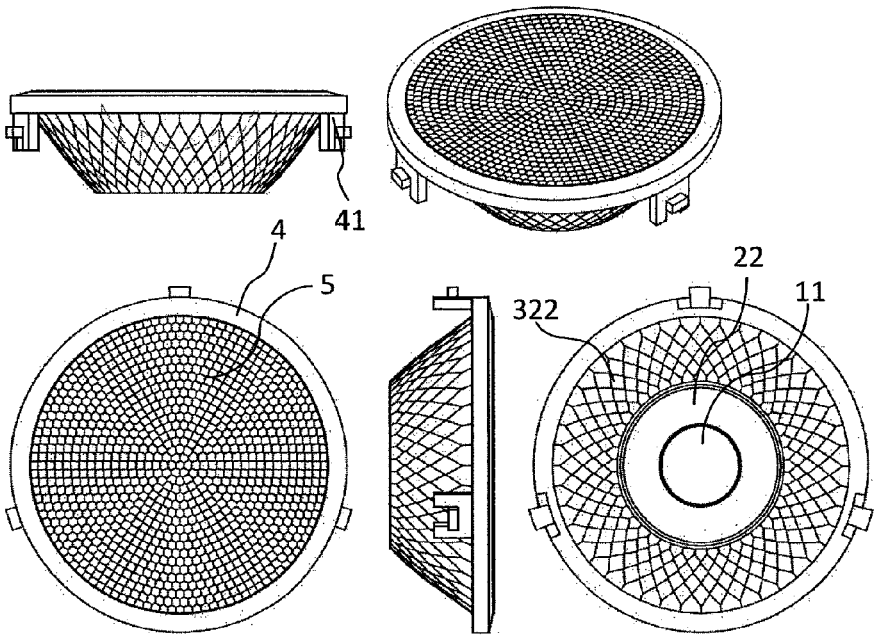
FIG. 10 shows different views of the secondary optical lens according to a second embodiment of the present invention.

The Embodiment 2 of the secondary optical lens involved in the present invention is shown in orthographic views in FIG. 10. The reflection surface 322 of the total reflection prism 3 in the outer round is designed to be a diamond flake polyhedral reflection surface, with the rest of the features remaining the same as those of the Embodiment 1. In this figure, it shows the front view, the isometric view, the plan view, the side view and the bottom view from the upper left area to the lower right area.

To the reflection surface 322 of the total reflection prism 3 in the outer round, each diamond flake thereon has substantially the same size as that of the corresponding square flake in the Embodiment 1. Thus, the light mixing effect substantially keeps the same except that the appearance differs from that of the Embodiment 1.

Other Embodiments

Figure 11:
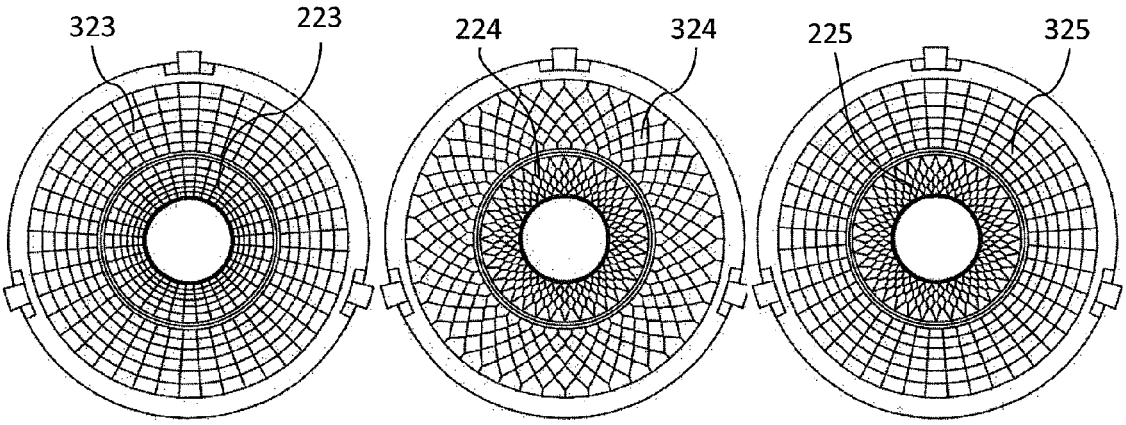
FIG. 11 shows the secondary optical lens according to a third embodiment, a fourth embodiment and a fifth embodiment of the present invention.

Other embodiments of the secondary optical lens of the present invention are shown in bottom views in FIG. 11. The reflection surface of the total reflection prism 2 in the inner round and the reflection surface of the total reflection prism 3 in the outer round may have the same or different shapes in their flake polyhedral reflection surfaces. In the Embodiment 3, the reflection surface 223 of the total reflection prism 2 in the inner round and the reflection surface 323 of the total reflection prism 3 in the outer round simultaneously have the same shape in their square flake reflection surfaces. In the Embodiment 4, the reflection surface 224 of the total reflection prism 2 in the inner round and the reflection surface 324 of the total reflection prism 3 in the outer round simultaneously have the same shape in their diamond flake reflection surfaces. However, in the Embodiment 5, the reflection surface 225 of the total reflection prism 2 in the inner round has a diamond flake reflection surface, while the reflection surface 325 of the total reflection prism 3 in the outer round has a different shaped square flake reflection surfaces. The flake reflection surface effects mainly light mixing, which may produce the consistent color temperature in the centre and at the edge of the projected light spot with respect to the multi-chip white LED, and eliminate the shadow as the arrangement of the LED chips in the light spot projected due to imaging effect.

The foregoing description of an implementation of the invention has been presented for purpose of illustration and description. It is not exclusive and does not limit the invention to the precise form disclosed. Modifications and variations are possible in light of the above teachings or may be acquired from practicing the invention.

What is claimed is:

1. A lens comprising:

(a) a light-exiting surface provided on a top side of the lens;

(b) a central light-refracting and collimating portion comprising a convex aspheric surface formed on a bottom side of the lens at a centre thereof for refracting and collimating a first portion of light emitting from an LED (light emitting diode) towards the light-exiting surface;

(c) a first annular prism portion formed around the central light-refracting and collimating portion, and having a first refractive surface and a first total reflective surface, whereby a second portion of the light emitting from the LED is refracted by the first refractive surface and then reflected by the first total reflective surface into parallel beams towards the light-emitting surface; and (d) a second annular prism portion formed around the first annular prism portion, and having a second refractive surface and a second total reflective surface, whereby a third portion of the light emitting from the LED is refracted by the second refractive surface and then reflected by the second total reflective surface into parallel beams towards the light-emitting surface, wherein at least one of the first and second total reflective surfaces is in the form of a scale-like polyhedron.

2. The lens as claimed in claim 1, wherein the light-exiting surface comprises an array of micro lens.

3. The lens as claimed in claim 2, wherein the light distribution angle of the micro lens is about 8° to about 46°.

4. The lens as claimed in claim 2, wherein the array of micro lens is a radiant, hexagonal honeycomb or square grid.

5. The lens as claimed in claim 1, wherein both the first and the second total reflective surfaces are in the form of scale-like polyhedrons having the same shape.

6. The lens as claimed in claim 1, wherein both the first and the second total reflective surfaces are in the form of scale-like polyhedrons having different shapes.

7. The lens as claimed in claim 1, wherein the first total reflective surface is a smooth surface.

8. The lens as claimed in claim 1, wherein the LED is a single-chip or multi-chip LED, with one or more colors of red, green or blue.

9. The lens as claimed in claim 1, further comprising an annular flange formed around the second annular prism portion, and a plurality of lugs extending from the annular flange to facilitate the positioning of the lens.

10. A lens comprising:

a light-exiting surface provided on a top side of the lens;

a central light-refracting and collimating portion comprising a convex aspheric surface formed on a bottom side of the lens at a centre thereof for refracting and collimating a first portion of light emitting from an LED (light emitting diode) towards the light-exiting surface;

a first annular prism portion formed around the central light-refracting and collimating portion, and having a first refractive surface and a first total reflective surface, whereby a second portion of the light emitting from the LED is refracted by the first refractive surface and then reflected by the first total reflective surface into parallel beams towards the light-emitting surface; and a second annular prism portion formed around the first annular prism portion, and having a second refractive surface and a second total reflective surface, whereby a third portion of the light emitting from the LED is refracted by the second refractive surface and then reflected by the second total reflective surface into parallel beams towards the light-emitting surface, wherein the convex aspheric surface is configured to receive the first portion of the light emitting at an angle of about 0° to about 32° from an optical axis of the lens, the first refractive surface is configured to receive the second portion of the light emitting at an angle of about 32° to about 56° from the optical axis of the lens, and the second refractive surface is configured to receive the third portion of the light emitting at an angle of about 56° to about 90° from the optical axis of the lens.

11. A lens comprising:

a light-exiting surface provided on a top side of the lens;

a central light-refracting and collimating portion comprising a convex aspheric surface formed on a bottom side of the lens at a centre thereof for refracting and collimating a first portion of light emitting from an LED (light emitting diode) towards the light-exiting surface;

a first annular prism portion formed around the central light-refracting and collimating portion, and having a first refractive surface and a first total reflective surface, whereby a second portion of the light emitting from the LED is refracted by the first refractive surface and then reflected by the first total reflective surface into parallel beams towards the light-emitting surface; and a second annular prism portion formed around the first annular prism portion, and having a second refractive surface and a second total reflective surface, whereby a third portion of the light emitting from the LED is refracted by the second refractive surface and then reflected by the second total reflective surface into parallel beams towards the light-emitting surface, wherein the first total reflective surface in the form of a scale-like polyhedron has a surface that is square, hexagonal or diamond-shaped.

12. A lens comprising:

a light-exiting surface provided on a top side of the lens;

a central light-refracting and collimating portion comprising a convex aspheric surface formed on a bottom side of the lens at a centre thereof for refracting and collimating a first portion of light emitting from an LED (light emitting diode) towards the light-exiting surface;

a first annular prism portion formed around the central light-refracting and collimating portion, and having a first refractive surface and a first total reflective surface, whereby a second portion of the light emitting from the LED is refracted by the first refractive surface and then reflected by the first total reflective surface into parallel beams towards the light-emitting surface; and a second annular prism portion formed around the first annular prism portion, and having a second refractive surface and a second total reflective surface, whereby a third portion of the light emitting from the LED is refracted by the second refractive surface and then reflected by the second total reflective surface into parallel beams towards the light-emitting surface, wherein the second total reflective surface in the form of a scale-like polyhedron has a surface that is square, hexagonal or diamond-shaped.

* * * * *